US009038522B2

(12) United States Patent
Martin

(10) Patent No.: US 9,038,522 B2
(45) Date of Patent: May 26, 2015

(54) SHIELD SUPPORT SYSTEM

(71) Applicant: Alejandro Martin, Morristown, NJ (US)

(72) Inventor: Alejandro Martin, Morristown, NJ (US)

( * ) Notice: Subject to any disclaimer, the term of this patent is extended or adjusted under 35 U.S.C. 154(b) by 0 days.

(21) Appl. No.: 13/760,959

(22) Filed: Feb. 6, 2013

(65) Prior Publication Data

US 2013/0205983 A1 Aug. 15, 2013

Related U.S. Application Data

(60) Provisional application No. 61/595,357, filed on Feb. 6, 2012.

(51) Int. Cl.

| | |
|---|---|
| ***F41H 5/12*** | (2006.01) |
| ***F41H 5/013*** | (2006.01) |
| ***F41H 5/26*** | (2006.01) |
| ***F41H 5/08*** | (2006.01) |

(52) U.S. Cl.

CPC ..... *F41H 5/013* (2013.01); *F41H 5/26* (2013.01); *F41H 5/12* (2013.01); *F41H 5/08* (2013.01)

(58) Field of Classification Search

CPC ..... F41H 5/08; F41H 5/10; F41H 5/12; F41H 5/14; F41H 5/26

USPC ..... 89/36.06, 36.07, 36.09

See application file for complete search history.

(56) References Cited

U.S. PATENT DOCUMENTS

| | | | | | |
|---|---|---|---|---|---|
| 1,320,888 | A | * | 11/1919 | Miller et al. | 89/36.06 |
| 2,306,708 | A | * | 12/1942 | Mendel | 42/106 |
| 4,867,273 | A | * | 9/1989 | Schaevitz | 182/116 |
| 5,293,807 | A | | 3/1994 | Hajdu | |
| 5,345,706 | A | * | 9/1994 | Brown | 42/94 |
| 2002/0104429 | A1 | | 8/2002 | Euler | |
| 2006/0230916 | A1 | | 10/2006 | Sand | |
| 2010/0218670 | A1 | * | 9/2010 | Keng | 89/37.04 |
| 2011/0011255 | A1 | | 1/2011 | Kleniatis et al. | |

FOREIGN PATENT DOCUMENTS

| | | | |
|---|---|---|---|
| GB | 4376 | * | 0/1915 |
| GB | 2221286 | * | 1/1990 |

* cited by examiner

*Primary Examiner* — Stephen M Johnson

(74) *Attorney, Agent, or Firm* — The Law Firm of Andrea Hence Evans, LLC

(57) ABSTRACT

The invention features a support system which can be attached to a ballistic shield. The system features at least one telescoping or retractable leg which is mounted to the shield to create a standalone shield. The shield is positioned between plates which receive pins that hold the shield in position in the system. The system features a resting platform which provides an area for resting a gun or rifle, for example. A bullet proof screen extends from the bottom area of the shield towards the base of the system and provides additional security to the user when the shield is in the system.

6 Claims, 9 Drawing Sheets

SHIELD SUPPORT SYSTEM

RELATED U.S. APPLICATION DATA

This application claims the benefit of provisional application No. 61/595,357 filed Feb. 6, 2012.

FIELD OF THE INVENTION

The present invention relates, in general, to an extendable and retractable support which attaches to a ballistic shield so that the shield can stand alone.

BACKGROUND OF THE INVENTION

A ballistic shield or tactical shield is a hand-held shield that is capable of defending the user from handguns, shotguns and submachine guns. They are typically used by law enforcement or military during dangerous life or death situations. The average shield weighs 40 pounds and is held by a user for a minimum time of 15 to 20 minutes. It is difficult to hold the shield in an upright position without getting fatigued and without having a sore arm from supporting the weight of the shield. Being fatigued and having sore arms may cause the user to be more vulnerable in a dangerous situation. The fatigue and soreness causes the user to pass the shield to his partner exposing the user to an immediate deadly threat.

SUMMARY OF THE INVENTION

The present invention provides a support system which can be attached to a ballistic shield so the user can use the system when fatigued, sore or immobile and then collapse the system when the user desires to be mobile.

An aspect of an embodiment of the invention provides plates which mount retractable legs to the ballistic shield affording the shield the ability to be raised and lowered to a desired height.

A further aspect of an embodiment of the invention features a base provided between the legs to provide additional support and stability.

A further aspect of an embodiment of the invention features a bullet proof screen extending from the bottom of the shield to the base of the support system.

A further aspect of an embodiment of the invention features an internal sleeve that receives and supports the legs.

A further aspect of an embodiment of the invention features a resting platform which affords the user the ability to rest his rifle.

A further aspect of an embodiment of the invention features a hydraulic system that raises and lowers the legs.

A further aspect of an embodiment of the invention features a spring-loaded system that raises and lowers the legs.

Additional aspects, objectives, features and advantages of the present invention will become apparent from the following description of the preferred embodiments with reference to the attached drawings.

DETAILED DESCRIPTION OF THE INVENTION

Figure 1:
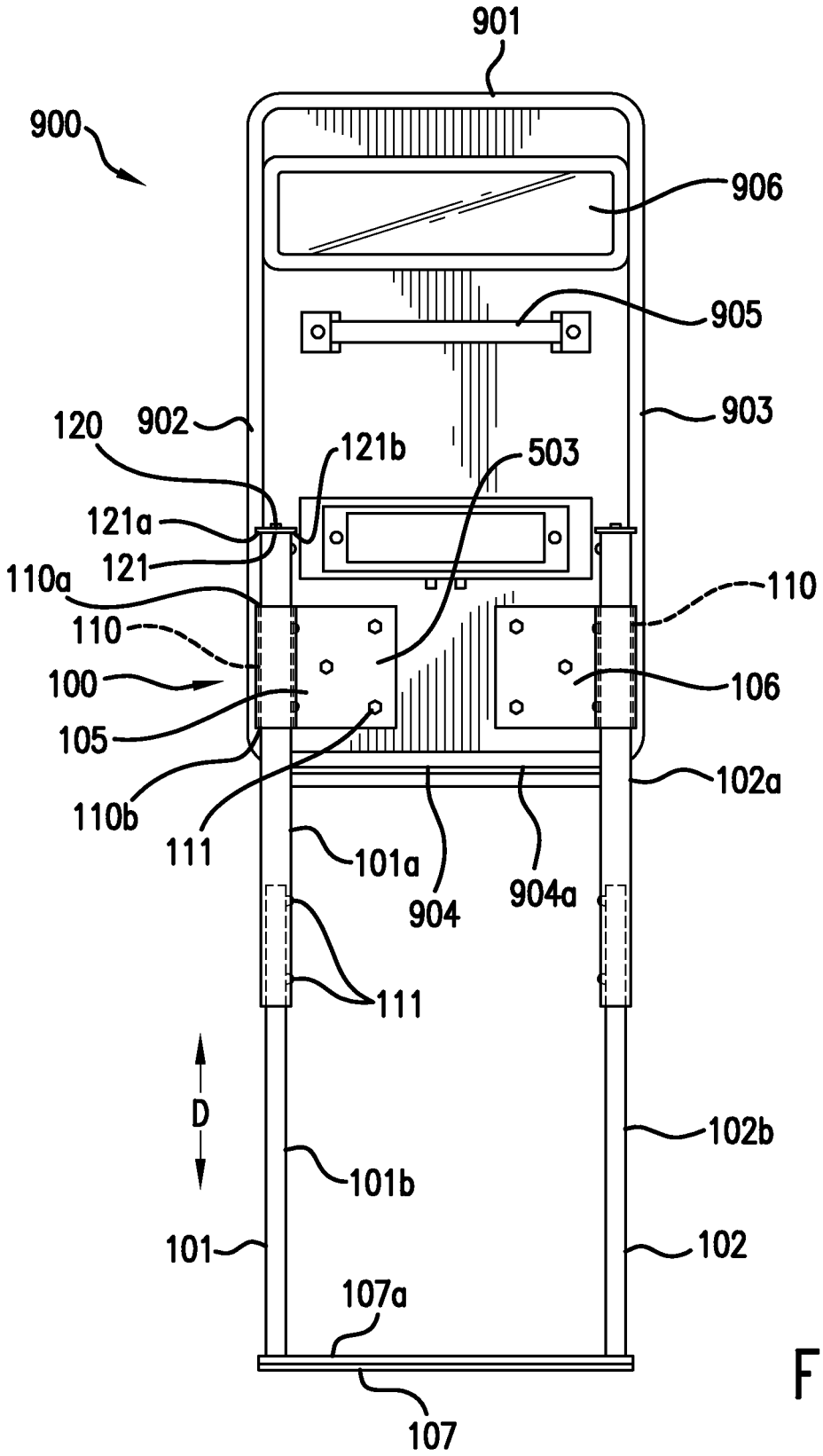
FIG. 1 is a perspective view of an embodiment of the present invention showing the support system having two legs.

FIG. 1 is a perspective view of an embodiment of the present invention showing the support system 100 having two legs 101,102. The support system 100 features two mounting plates 105, 106 positioned on the left and right side of the shield 900, respectively. The shield 900 has a top side 901, left side 902, right sides 903 and bottom sides 904. A typical ballistic shield 900 has four straight sides with curved or straight edges. The shield 900 is a hand-held shield with a strap 905 that is capable of defending the user from handguns, shotguns and submachine guns. The shield is shaped sheet metal with a thin eye slot hole 906 for vision.

Figure 5:
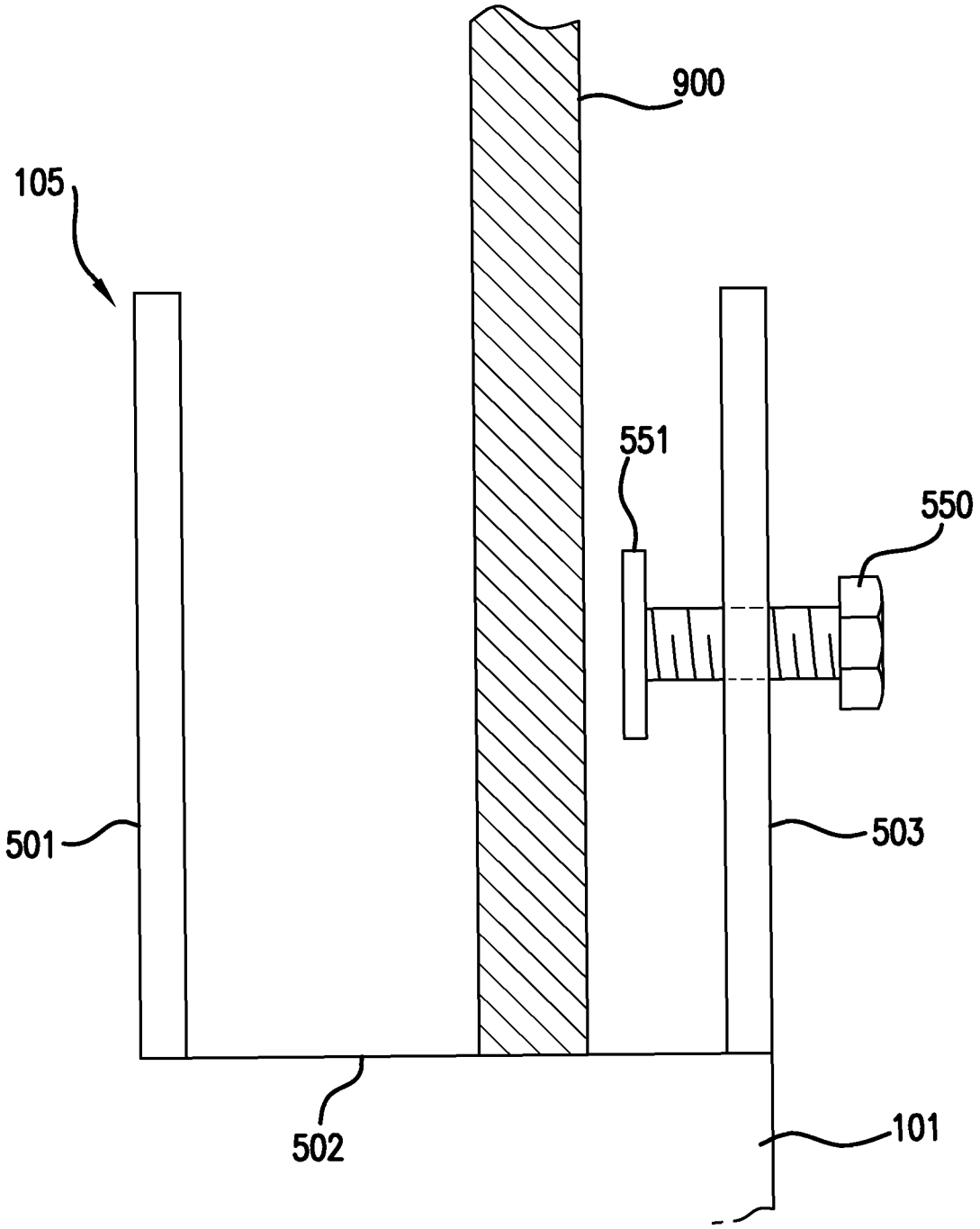
FIG. 5 is a perspective view of the present invention showing the shield being positioned between a mounting plate.
Figure 6:
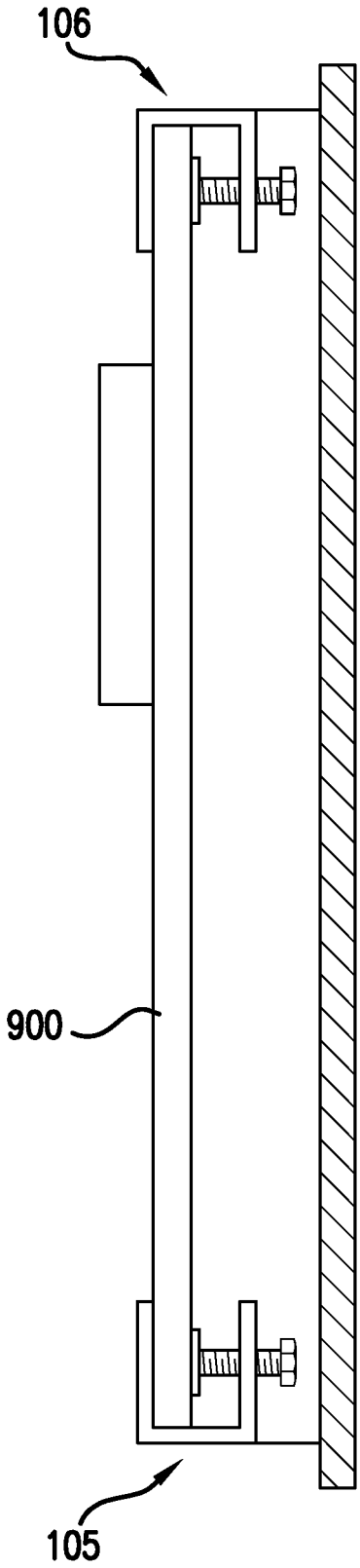
FIG. 6 is a perspective view of the present invention showing the shield support system attached to the shield by bolts.

In one embodiment, the plates can be mounted to the shield 900 using ½" stainless steel bolts and nuts 111. The plates 105, 106 are mounted near the bottom area of the shield 900. FIG. 5 is a perspective view of the present invention showing the shield being positioned between a mounting plate 105. Plates 105 and 106 are identical so only plate 105 will be described. The plates 105, 106 comprise a plate base 502 and a left plate side 501 and right plate side 503, where the right plate side 503 extends upward from the front of the base 502 and the left plate side 501 extends upward from the back end of the base 502. The right plate side 503 has openings which receive pins 550 having a thin plate or cap 551 on an end. The pins 550 extend through the openings towards the shield 900. So that the structure and integrity of the shield is not comprised, the pins are not inserted through the shield. Instead, the plate or cap 551 abuts the surface of the shield and holds the shield inside of the support system 100, as shown in FIG. 6. FIG. 6 is a perspective view of the present invention showing the shield support system attached to the shield by bolts. The left plate side 501 is symmetrical to the right plate side 503 and has aligning holes to receive pins to hold the shield's opposite side in place. The base 502 helps prevent the shield from shifting left or right when supported by the system. The plates are somewhat of a u-shaped structure. As shown in FIG. 1, two plates 105 and 106 are shown supporting a shield 900. The left side 902 of the shield and the right side 903 of the shield aligns with the base 502. The right plate side 503 aligns with the front side of the shield. The left plate side 501 aligns with the back side of the shield. Alternatively, a third plate 107 is shown where the bottom side 904 of the shield abuts with the inside base 502 and the left and right sides 501, 503 receive pins through its openings to secure the shield in place.

Each plate 105,106 supports a leg 101, 102 that extends downward a length from a middle area of the shield to a base or foot plate 107. The base 107 is positioned between the legs 101, 102 and adds additional support to the shield 900 when the legs 101,102 are extended. The base is perpendicular to the legs and helps to support the system. The base is preferably ¼"×2"×19" made from aluminum. However, alternate sizes and materials may be used which are durable. The legs

101, 102 are telescoping such they are adjustable a range of heights. Sleeves 110 at least the height of the plates 105, 106 are on the plates. The legs 101, 102 pass through the sleeves. The sleeves minimize damage to the plates 105, 106 as the legs pass through the sleeves. The sleeves 110 also help to guide the legs when moved in an up and down direction D. When the legs 101,102 moved up to its maximum height, the base plate 107 abuts the bottom 904*a* of the shield and the user can use the straps 905 on the shield 900 to carry the shield 900. When the legs are fully retracted, the shield can be transported to a different area.

Figure 9:
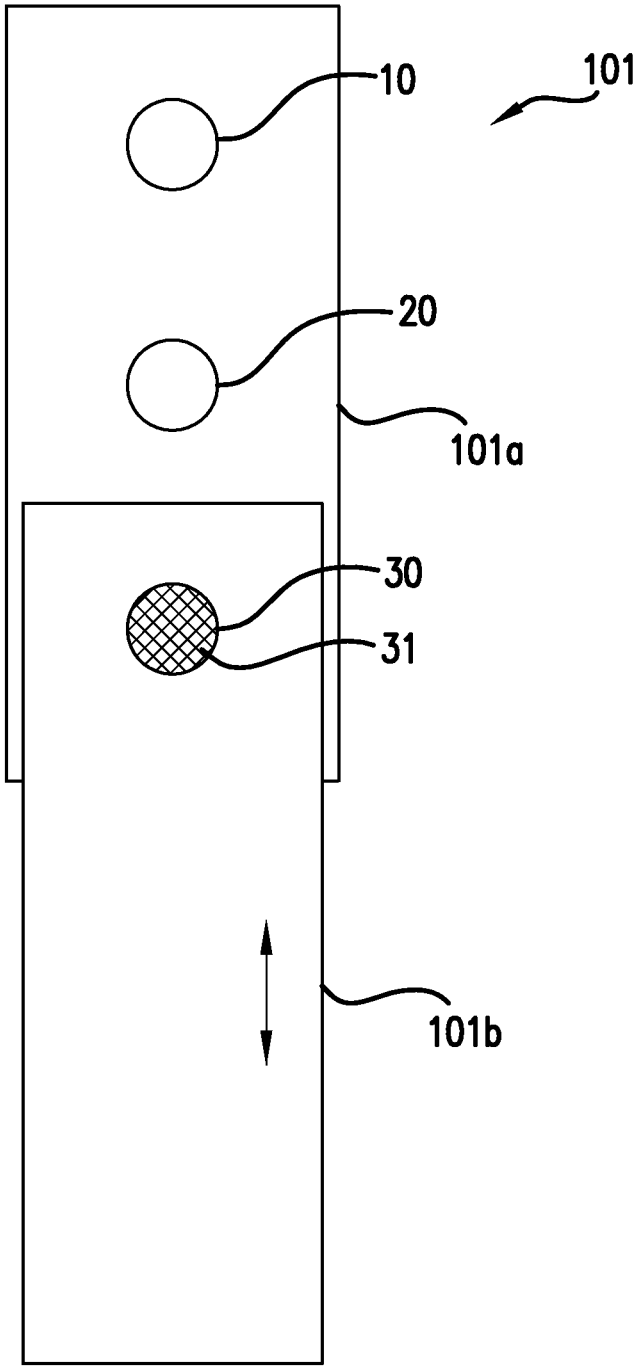
FIG. 9 is an illustration of a top and bottom portion of a leg.
Figure 1:
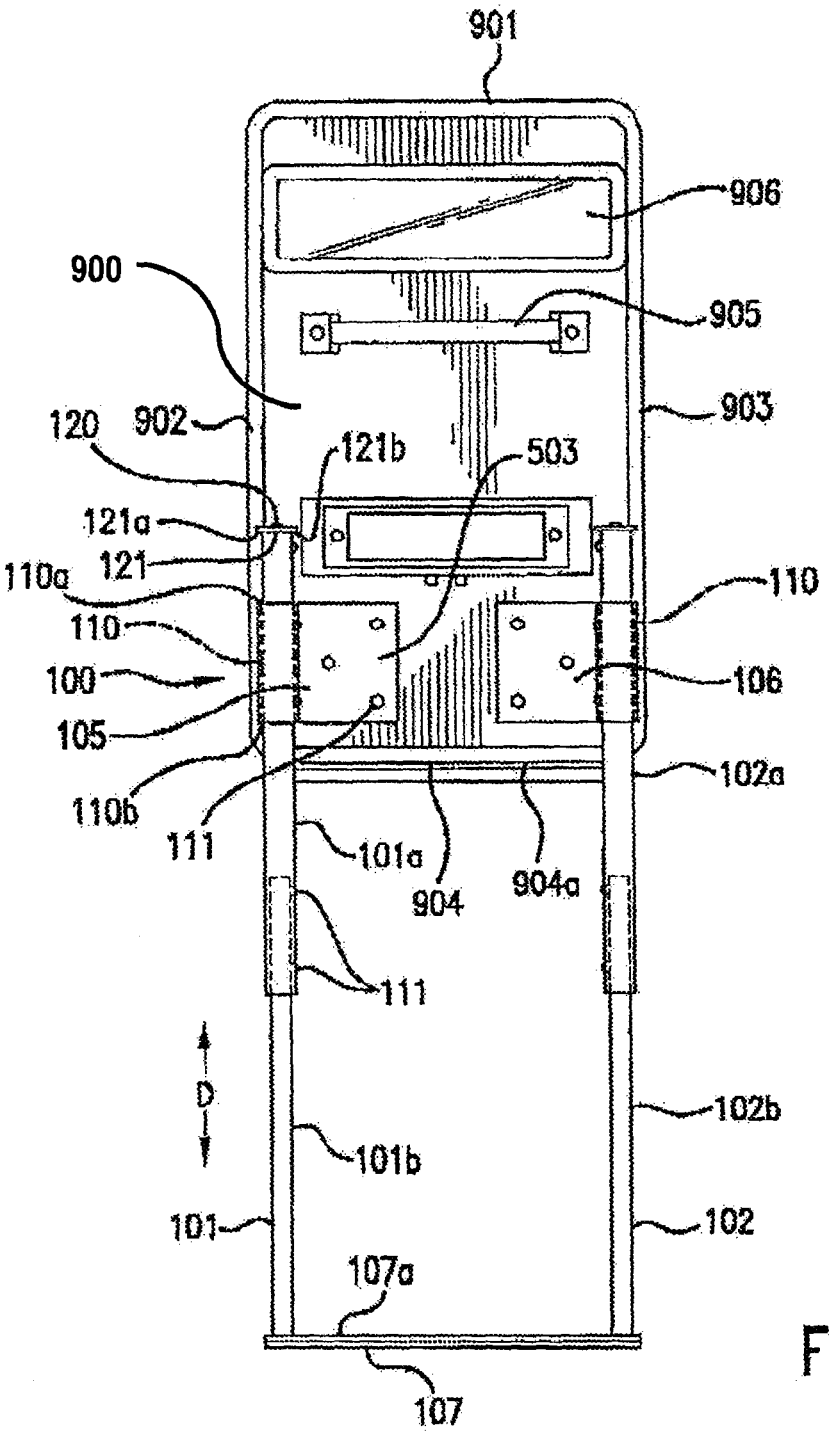
Figure 2:
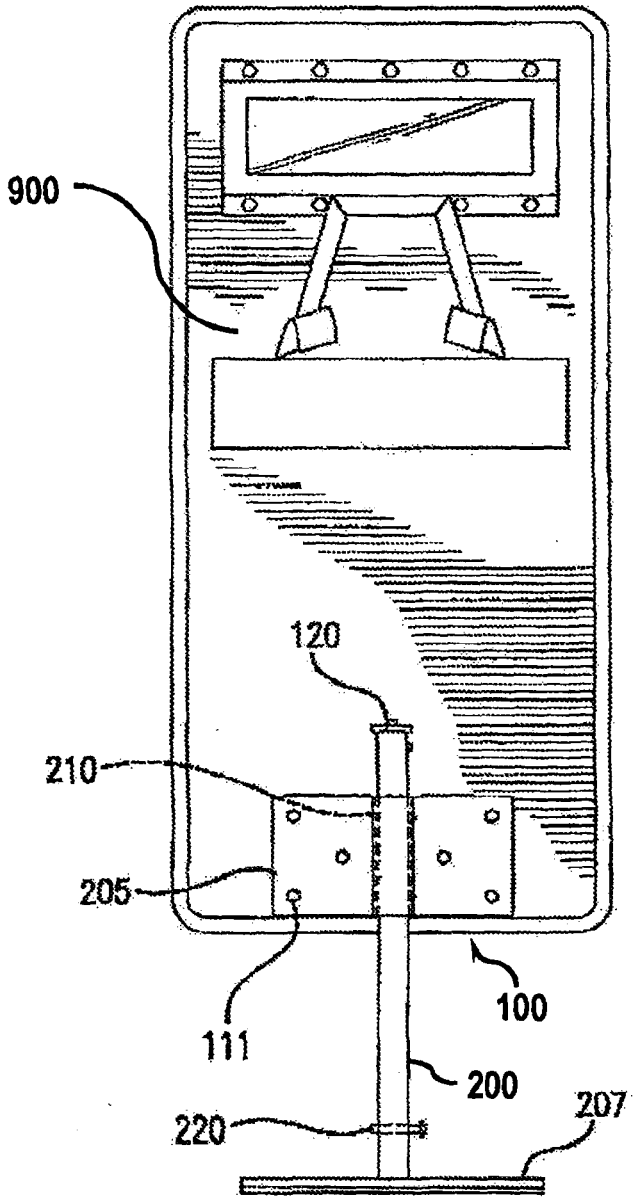
Figure 3:
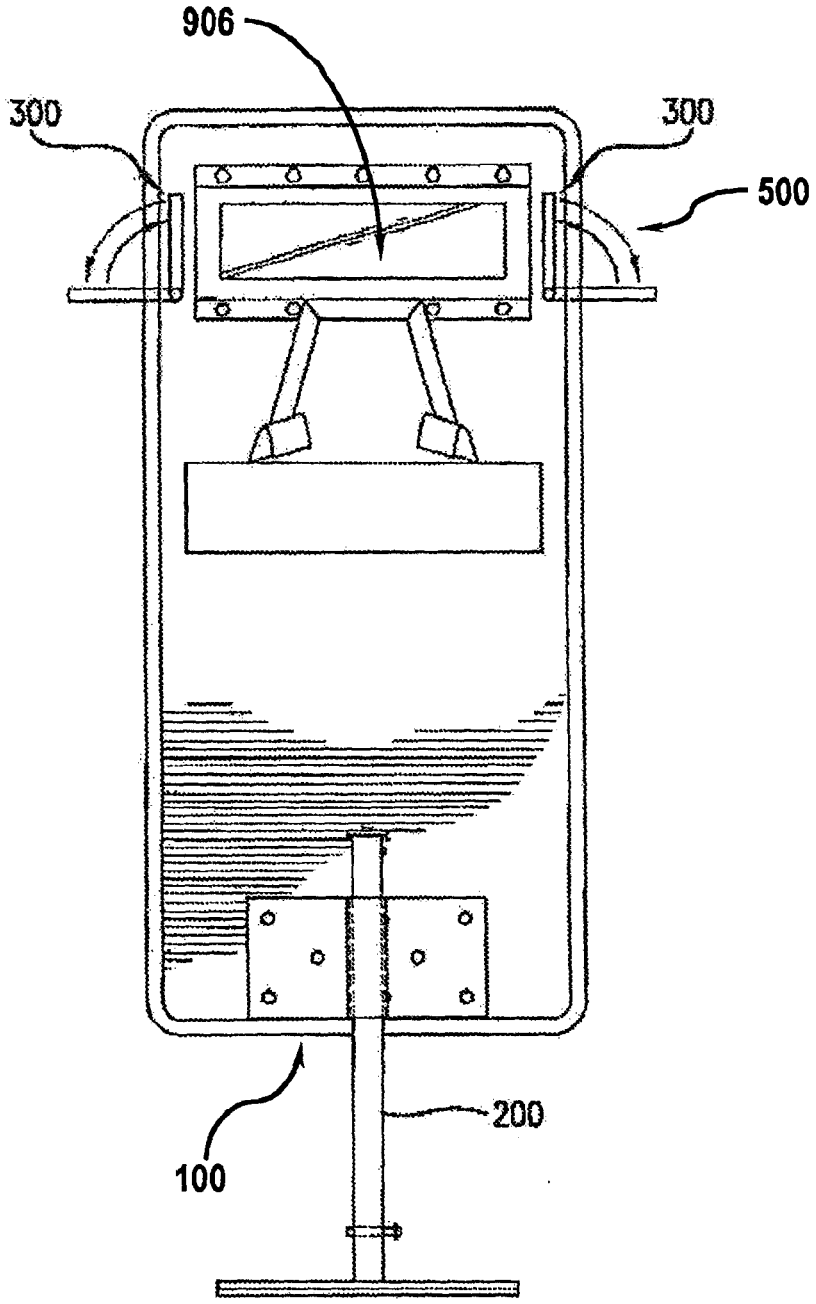
Figure 4:
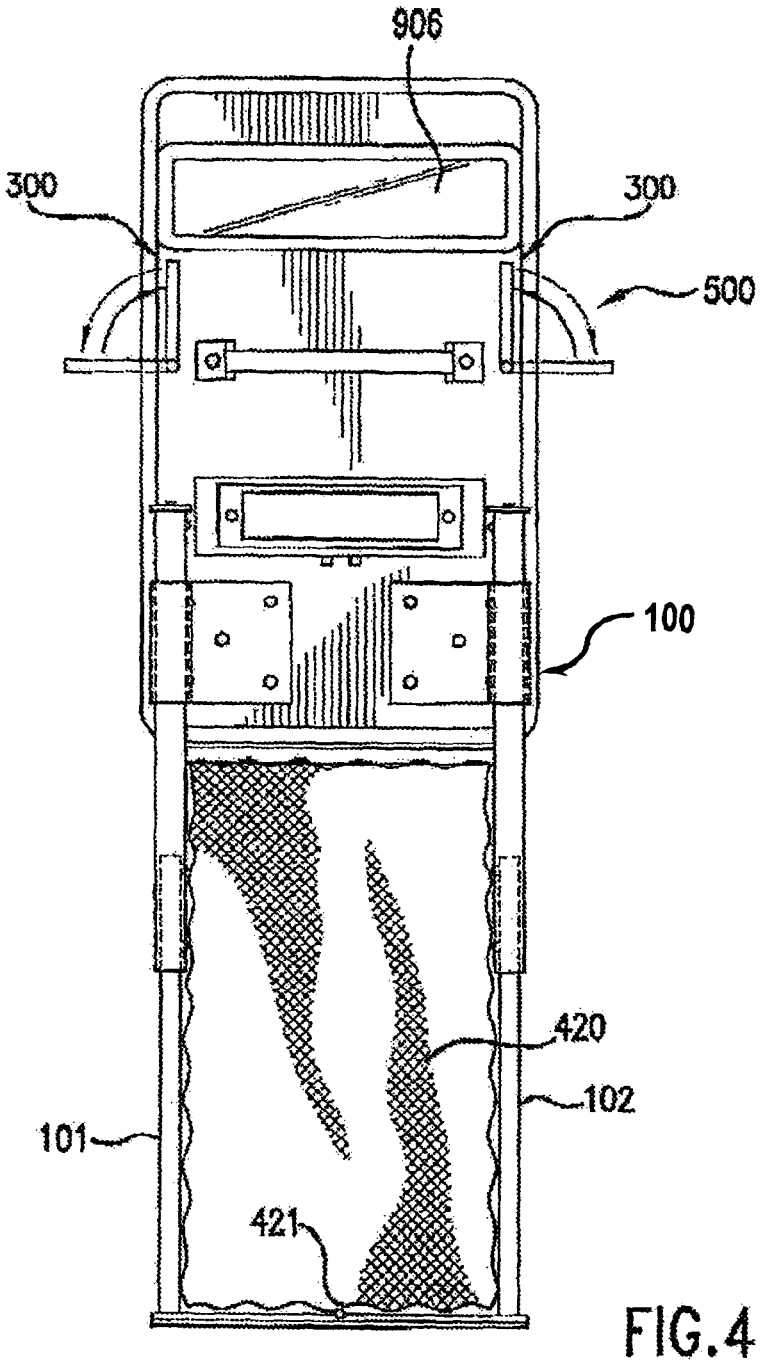
Figure 6:
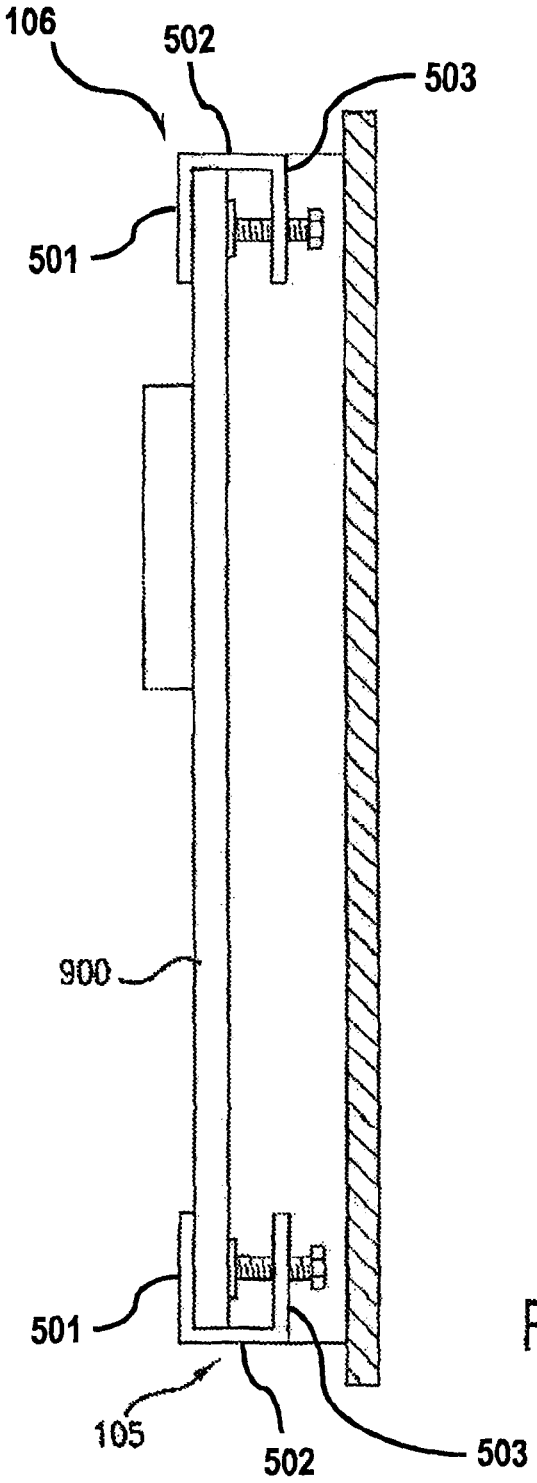

A removable aluminum cap 120 is featured on the top end 121 of the legs 101,102. The cap 120 can be opened to access the legs for servicing of the legs or for cleaning inside of the legs. The cap 120 ends extend over the edges 121*a*, 121*b* and abuts the top end 110*a* of the sleeve 110. The sleeve 110 is open at the bottom end 110*b* so that the legs 101, 102 pass through the sleeve 110 easily. The legs 101, 102 are secured to the base 107 so that when the bottom portion of the legs 101*b*, 102*b* are moved upward and pass through the sleeves 110, the connected base 107 is moved upwards so that the top surface 107*a* of the base contacts the bottom surface 907*a* of the shield 900. The top portions 101*a*, 102*a* of the legs receive the bottom portion 101*b*, 102*b* of the legs so that the bottom portion is secured inside of the top portions of the legs, as shown in FIG. 9. FIG. 9 is an illustration of a top and bottom portion of a leg. The top portion 101*a* of the leg 101 has openings 10, 20, 30. The bottom portion 101*b* of the leg 101 features spring loaded pin 31 that adjusts the height of the bottom portion of the leg. The spring loaded pin 31 is shown protruding through opening 30 in FIG. 9 securing the leg in an extended position. The top portion 101*a* of the leg 101 features openings on a second top portion side, wherein the spring loaded pin 31 extends through the second opening 10 to keep the bottom portion of the leg inside the top portion of the leg. The first opening 10 is at least the length of the bottom portion 101*b* of the leg so that entire bottom portion is concealed inside of the top portion.

The legs and base can be moved upwards so they do not interfere with the shield when the support system is not desired by the user. The base 107 is rubber so that it can somewhat grip the ground surface the system and connected shield are placed onto. A lower position on the legs feature additional nuts and bolts 111 to provide stability when the legs are extended.

Figure 2:
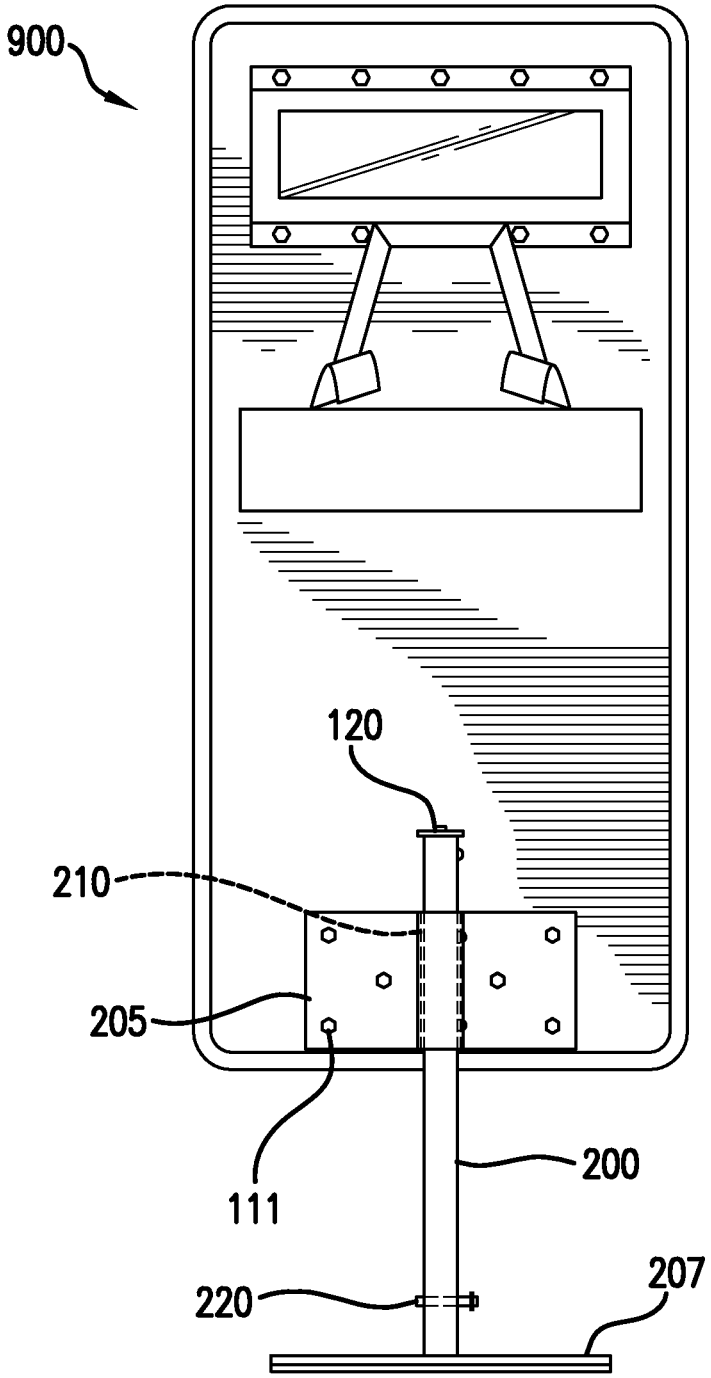
FIG. 2 is a perspective view of an embodiment of the present invention showing the support system having one leg.

FIG. 2 is a perspective view of an embodiment of the present invention showing the support system 100 having one leg 200. A mounting plate 205 is positioned in a middle bottom area of the sleeve 210 and secured to the shield using nuts and bolts 111, for example. The mounting plate 205 is configured like plates 105 and 106 discussed above. The shield is positioned between the left and right plate sides and held in place with screws whose ends touch the outside surface of the shield, but do not penetrate the shield. The plate is preferably ⅛"×6"×12"; however, alternate dimensions may be used depending on the size of the shield 801. The sleeve 210 is positioned in the middle of the place and supports one leg 200 which can be moved through the sleeve 210, as described above. A pin 220 is positioned near the bottom of the leg. The pin 220 is received through an opening on the leg 200 and locks the leg in a closed position, shown in FIG. 2. The leg 200 is supported by a rubber ¼"×2"×12" base plate 207, as described above. The leg 200 is secured to the base plate 207 such that the base plate and leg are moved upward and the base plate aids in securing the leg inside of the sleeve. Alternatively, the base plate may be removable having an opening sized to receive the bottom of the leg to support it, where the leg ends would fit inside an opening on the base plate.

Figure 4:
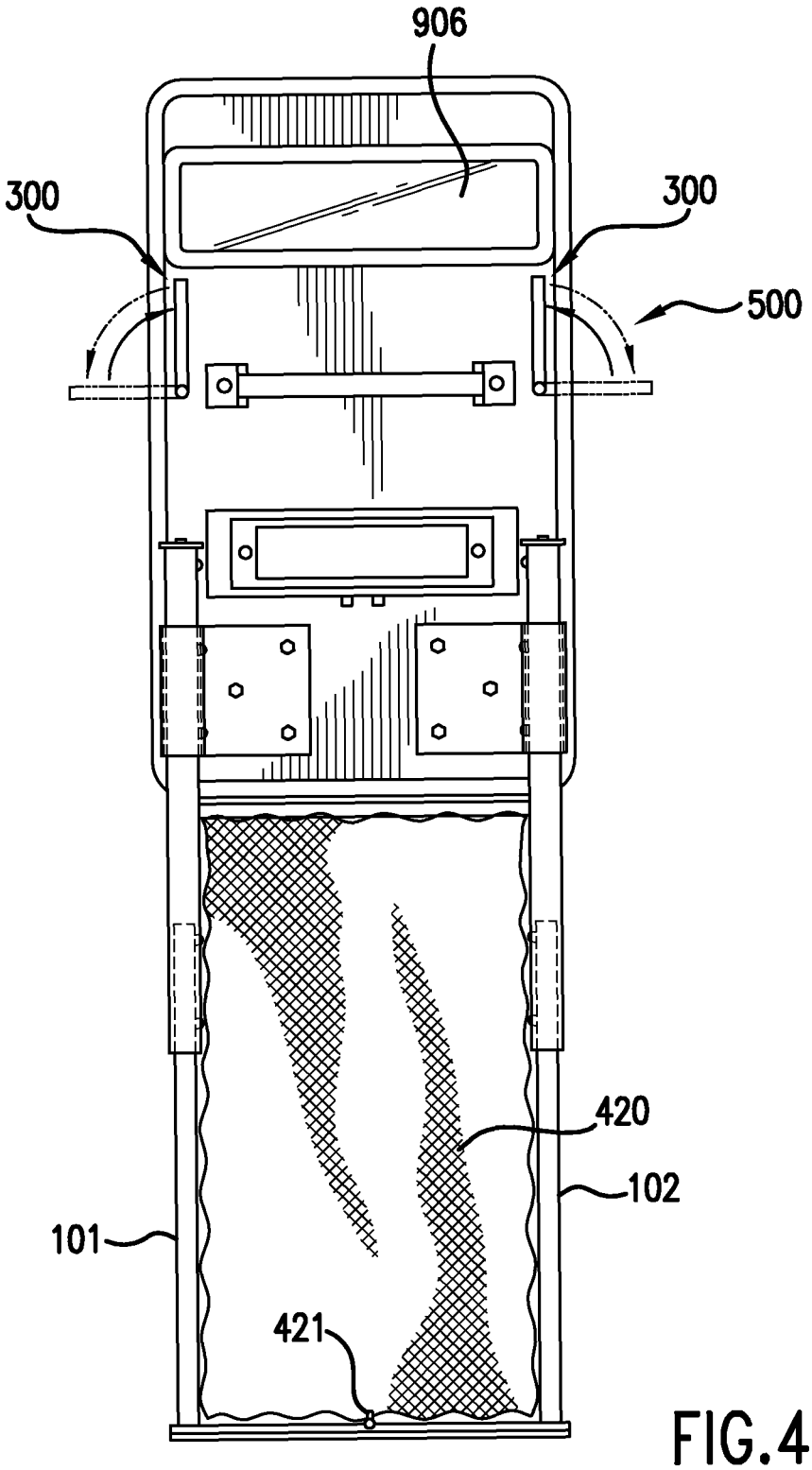
FIG. 4 is a perspective view of the present invention showing the support system having two legs and a resting platform.

A bullet proof screen 420, as shown in FIG. 4 can be positioned onto the legs of the support system 100 and moved in a downward position towards the base plate. The screen is sufficiently bullet resistant such that bullets fired will cause the sheet to deform but not penetrate the sheet. A latch on the bottom of the screen 421 can be connected to the base to keep the screen in a downward and extended position. Then, when the legs are extended through the sleeve, the user can position the screen to secure the bottom portion of the user's body not secured and covered by the shield. The screen 420 can be attached to the legs by known attachment mechanisms such as a hooks, pins or screws.

Figure 3:
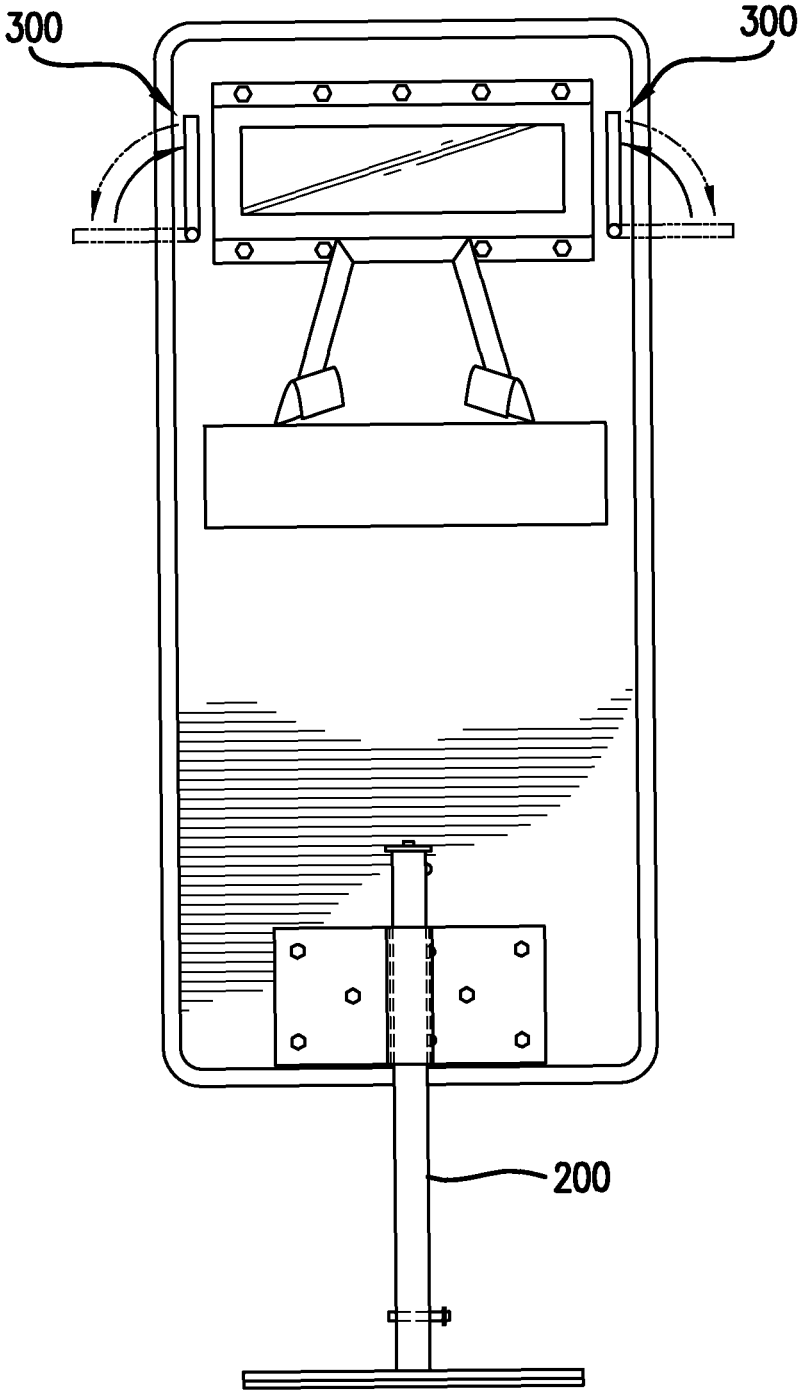
FIG. 3 is a perspective view of the present invention showing the support system having one leg and a resting platform.

The shield can be modified by resting platforms 300 on the shield, as shown in FIG. 3 and FIG. 4. FIG. 3 is a perspective of the present invention showing the support system 100 having one leg 200 and a resting platform 300. FIG. 4 is a perspective of the present invention showing the support system 100 having two legs 101, 102 and resting platforms 300. The resting platform 300 is positioned underneath the window 906 on the shield. The platform 300 is secured to the shield on one end by a hinge so that the platform can move in a closed position towards the shield or in an open position in a diagonal direction shown by 500. In an open position, the platform will move to extend over the left of right sides of the shield. When opened as shown in FIGS. 3 and 4, the user can rest his weapon on the platform. The platform is a ledge sized to receive and support the weapon.

The user can release the legs and the platform when fatigued, sore or immobile and then collapse the system when the user desires to be mobile. The shield may be raised about 4 to 5 feet and lowered to a desired height.

Figure 8:
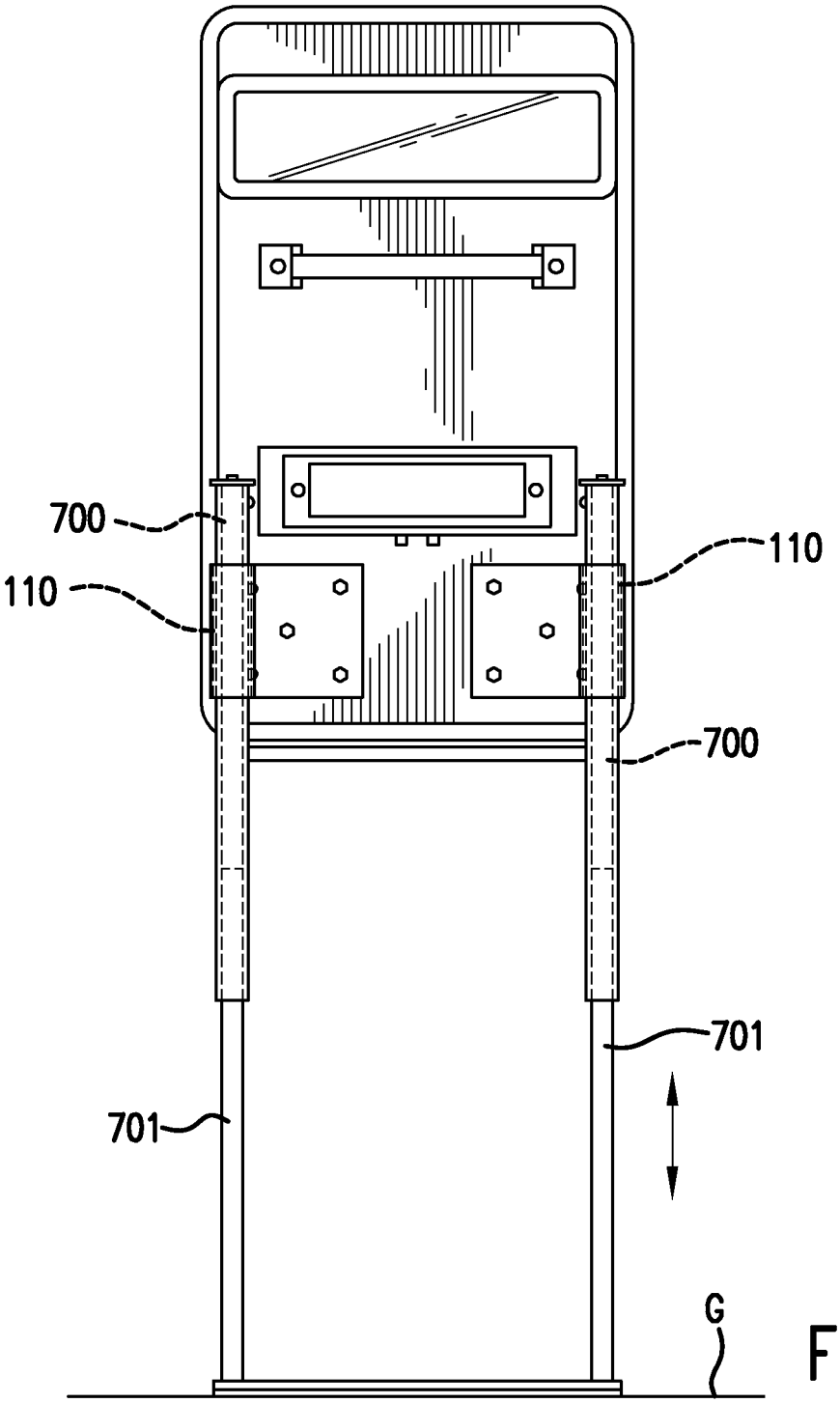
FIG. 8 is a perspective of the present invention showing a hydraulic system which raises and lowers the legs of the support system.

FIG. 8 is a perspective of the present invention showing a hydraulic system which raises and lowers the legs of the support system. As shown in FIG. 8, in another embodiment, a double acting hydraulic cylinder 700 extends through sleeve 110 and contacts the legs 701 enabling active movement of the so that the leg is extended downward or moved upward to lower or raise the shield and to support the shield attached to the support system at a desired height. Pressurized hydraulic fluid, which is typically oil or air, powers the cylinder 700. The hydraulic cylinder consists of a cylinder barrel, in which a piston connected to a piston rod moves up and down. Double acting hydraulic cylinders have two opposite facing piston surfaces that control the operation of the force of the hydraulic liquid. The barrel is closed on one end by the cylinder bottom and the other end by the cylinder head where the piston rod comes out of the cylinder. The piston has sliding rings and seals. The piston divides the inside of the cylinder into two chambers, the bottom chamber and the piston rod side chamber. The piston rod also has mounting attachments to connect the cylinder to the leg 701 it is moving in an upwards and downwards direction. When pressurized hydraulic fluid enters the system, the leg is moved downward towards the ground surface G. When pressurized fluid is discontinued, the leg retracts upwards.

Figure 7:
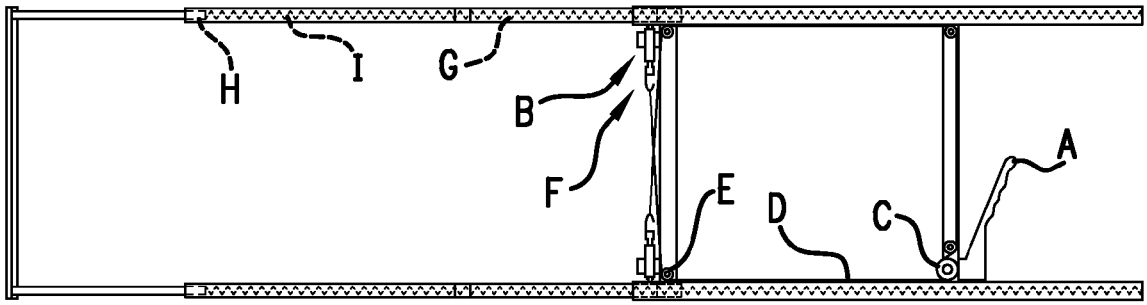
FIG. 7 is a perspective of the present invention showing a pulley system which raises and lowers the legs of the support system.

FIG. 7 is a perspective of the present invention showing a pulley system which raises and lowers the legs of the support system. Actuating lever (A) retracts blunt-nose spring plungers (B) via wire reel (C), wire rope (D), pulleys (E) and adjustable devises (F) permitting main spring (G) to retract upper section. Retracting upper section axially co-locates blunt nose spring plungers (B) with ball-nose spring plungers (H). Releasing lever (A) with upper section retracted causes blunt-nose spring plungers (B) to depress ball-nose plungers (H) permitting lower spring (I) to retract lower section.

The invention has been described in detail with particular reference to certain preferred embodiments thereof, but it will be understood that variations and modifications can be effected within the spirit and scope of the invention.

The invention claimed is:

1. A shield support system comprising:

at least one plate having at least one opening for securing the support system directly to a shield, wherein the shield is positioned in the at least one opening on the at least one plate;

at least one sleeve on the at least one plate that receives at least one leg, wherein the at least one leg comprises a top portion and a bottom portion and the at least one leg extends in a downward direction through the at least one sleeve, wherein the top portion comprises a first opening on a first top portion side, wherein the bottom portion features a first spring loaded pin that extends through the first opening to secure the at least one leg in an extended position.

2. The shield support system of claim 1 further comprising a second opening on a second top portion side, wherein the first spring loaded pin extends through the second opening to keep the bottom portion of the leg inside the top portion of the leg.

3. The shield support system of claim 1 further comprising a base on a bottom of the least one leg, wherein the base is perpendicular to the at least one leg and helps support the system.

4. The shield support system of claim 3, wherein a bullet resistant screen connects from the at least one leg to the base on the bottom of the at least one leg.

5. The shield support system of claim 1, wherein the at least one plate comprises a plate base and a left plate side and right plate side extending upward from the front and back ends of the base, respectively.

6. The shield support system of claim 5, wherein the left plate side and the right plate side comprise openings that receive pins, wherein the pins secure the shield in the support system.

* * * * *

UNITED STATES PATENT AND TRADEMARK OFFICE

CERTIFICATE OF CORRECTION

PATENT NO. : 9,038,522 B2
APPLICATION NO. : 13/760959
DATED : May 26, 2015
INVENTOR(S) : Alejandro Martin It is certified that error appears in the above-identified patent and that said Letters Patent is hereby corrected as shown below:

Delete Title page with illustrative figure, and replace with new Title page with illustrative figure. (attached)

In the Drawings,

Delete Drawing sheets 1-4 and 6, replace with Drawing sheets 1-4 and 6. (attached)

In the Specification,

Column 2, line 7, "FIG. 7 is a perspective of the present invention" should read -- FIG. 7 is a perspective view of the present invention --;

Column 2, line 10, "FIG 8 is a perspective of the present invention" should read -- FIG. 8 is a perspective view of the present invention --;

Column 3, line 23, "107a of the base contacts the bottom surface 907a of the" should read -- 107a of the base contacts the bottom surface 904a of the --;

Column 3, line 57, "be used depending on the size of the shield 801." should read -- be used depending on the size of the shield 900. --;

Column 4, line 36, "FIG. 8 is a perspective of the present invention" should read -- FIG. 8 is a perspective view of the present invention --; and Column 4, line 60, "FIG. 7 is a perspective of the present invention" should read -- FIG. 7 is a perspective view of the present invention --.

Signed and Sealed this
Twenty-ninth Day of March, 2016

Michelle K. Lee

Michelle K. Lee
*Director of the United States Patent and Trademark Office*

(12) United States Patent
Martin

(10) Patent No.: US 9,038,522 B2
(45) Date of Patent: May 26, 2015

(54) SHIELD SUPPORT SYSTEM

(71) Applicant: Alejandro Martin, Morristown, NJ (US)

(72) Inventor: Alejandro Martin, Morristown, NJ (US)

( * ) Notice: Subject to any disclaimer, the term of this patent is extended or adjusted under 35 U.S.C. 154(b) by 0 days.

(21) Appl. No.: 13/760,959

(22) Filed: Feb. 6, 2013

(65) Prior Publication Data

US 2013/0205983 A1 Aug. 15, 2013

Related U.S. Application Data

(60) Provisional application No. 61/595,357, filed on Feb. 6, 2012.

(51) Int. Cl.

| | |
|---|---|
| ***F41H 5/12*** | (2006.01) |
| ***F41H 5/013*** | (2006.01) |
| ***F41H 5/26*** | (2006.01) |
| ***F41H 5/08*** | (2006.01) |

(52) U.S. Cl.

CPC ..... *F41H 5/013* (2013.01); *F41H 5/26* (2013.01); *F41H 5/12* (2013.01); *F41H 5/08* (2013.01)

(58) Field of Classification Search

CPC ..... F41H 5/08; F41H 5/10; F41H 5/12; F41H 5/14; F41H 5/26

USPC ..... 89/36.06, 36.07, 36.09

See application file for complete search history.

(56) References Cited

U.S. PATENT DOCUMENTS

| | | | | | |
|---|---|---|---|---|---|
| 1,320,888 | A | * | 11/1919 | Miller et al. | 89/36.06 |
| 2,306,708 | A | * | 12/1942 | Mendel | 42/106 |
| 4,867,273 | A | * | 9/1989 | Schacvitz | 182/116 |
| 5,293,807 | A | | 3/1994 | Hajdu | |
| 5,345,706 | A | * | 9/1994 | Brown | 42/94 |
| 2002/0104429 | A1 | | 8/2002 | Euler | |
| 2006/0230916 | A1 | | 10/2006 | Sand | |
| 2010/0218670 | A1 | * | 9/2010 | Keng | 89/37.04 |
| 2011/0011255 | A1 | | 1/2011 | Kleniatis et al. | |

FOREIGN PATENT DOCUMENTS

| | | | |
|---|---|---|---|
| GB | 4376 | * | 0/1915 |
| GB | 2221286 | * | 1/1990 |

* cited by examiner

*Primary Examiner* — Stephen M Johnson

(74) *Attorney, Agent, or Firm* — The Law Firm of Andrea Hence Evans, LLC

(57) ABSTRACT

The invention features a support system which can be attached to a ballistic shield. The system features at least one telescoping or retractable leg which is mounted to the shield to create a standalone shield. The shield is positioned between plates which receive pins that hold the shield in position in the system. The system features a resting platform which provides an area for resting a gun or rifle, for example. A bullet proof screen extends from the bottom area of the shield towards the base of the system and provides additional security to the user when the shield is in the system.

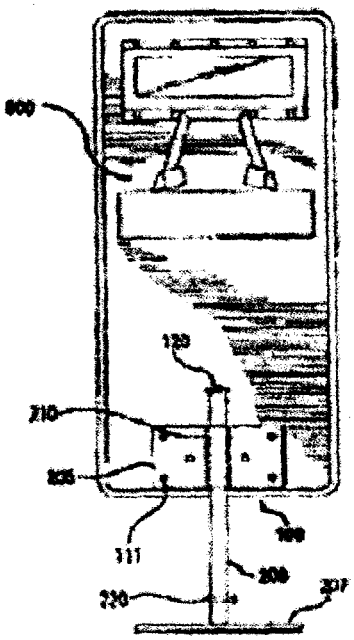

6 Claims, 9 Drawing Sheets